US008695159B2

(12) United States Patent
Van Der Kooi et al.

(10) Patent No.: US 8,695,159 B2
(45) Date of Patent: Apr. 15, 2014

(54) VACUUM CLEANER

(75) Inventors: Johannes Tseard Van Der Kooi, Drachten (NL); Fokke Roelof Voorhorst, Drachten (NL); Bastiann Johannes De Wit, Drachten (NL); Joldert Maria Boersma, Drachten (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/508,488

(22) PCT Filed: Dec. 3, 2010

(86) PCT No.: PCT/IB2010/055565
§ 371 (c)(1),
(2), (4) Date: May 7, 2012

(87) PCT Pub. No.: WO2011/070490
PCT Pub. Date: Jun. 16, 2011

(65) Prior Publication Data

US 2012/0266408 A1 Oct. 25, 2012

(30) Foreign Application Priority Data

Dec. 10, 2009 (EP) ..... 09178646

(51) Int. Cl.
*A47L 9/16* (2006.01)

(52) U.S. Cl.
USPC ..... 15/353; 55/406; 55/418; 55/426; 55/DIG. 3

(58) Field of Classification Search
USPC ..... 15/347, 353, 327.1; 55/400, 401, 406, 55/426, 427, 418; 95/270, 276; 96/329, 96/332, 333
See application file for complete search history.

(56) References Cited

U.S. PATENT DOCUMENTS 1,841,556 A * 1/1932 Stelz ..... 96/57
2,540,919 A * 2/1951 Vallas ..... 55/413

(Continued)

FOREIGN PATENT DOCUMENTS

CA 978485 A1 11/1975
DE 742954 C 11/1944

(Continued)

OTHER PUBLICATIONS

Vacuum Cleaner Guide—How Dyson Dual Cyclone Cleaners Work, www.espares.co.uk/guides/vacuum-cleaners/g/11/230/how-dysons-work.html, Apr. 16, 2009.

*Primary Examiner* — Mark Spisich
*Assistant Examiner* — Andrew A Horton

(57) ABSTRACT

A vacuum cleaner (1, 21, 31) comprises an air inlet opening (3), an air outlet opening (6) and a rotatable separator (9) for separating air and airborne particles. The separator (9) comprises at least one air entrance opening (109) located between the air inlet opening (3) and the air outlet opening (6). The vacuum cleaner (1, 21, 31) is provided with air-guide means (15, 22, 37) for guiding at least part of the air towards the separator (9). In use, the air-guide means (15, 22, 37) provides an at least partially closed boundary in axial direction for a column of rotating air (17) around the separator (9). The minimum distance (Rag) of an edge (115, 122) of the air-guide means (15, 22, 37) to the rotating axis (11) of the separator (9) is larger than a distance (Rs) of the air entrance opening (109) of the separator (9) to the rotating axis (11) of the separator (9).

10 Claims, 4 Drawing Sheets

(56) References Cited

U.S. PATENT DOCUMENTS

| | | | | |
|---|---|---|---|---|
| 3,290,865 | A * | 12/1966 | Serou et al. | 96/406 |
| 5,638,574 | A * | 6/1997 | Haupt et al. | 15/330 |
| 6,689,225 | B2 * | 2/2004 | Illingworth | 134/21 |
| 7,381,234 | B2 | 6/2008 | Oh | |
| 2003/0208879 | A1 * | 11/2003 | Oh et al. | 15/352 |
| 2004/0177471 | A1 * | 9/2004 | Jung et al. | 15/352 |
| 2009/0019821 | A1 | 1/2009 | Han et al. | |
| 2009/0113661 | A1 * | 5/2009 | Nakayama et al. | 15/344 |

FOREIGN PATENT DOCUMENTS

| | | | |
|---|---|---|---|
| EP | 1754437 | A2 | 2/2007 |
| EP | 2025277 | A2 | 2/2009 |
| GB | 2372200 | A * | 8/2002 |
| WO | 9203210 | A1 | 3/1992 |
| WO | 2007120535 | A2 | 10/2007 |
| WO | WO 2009051545 | A1 * | 4/2009 |

* cited by examiner

VACUUM CLEANER

FIELD OF THE INVENTION

The invention relates to a vacuum cleaner comprising an air inlet opening, an air outlet opening, a chamber and a rotatable separator for separating air and airborne particles, which separator comprises at least one air entrance opening located between the air inlet opening and the air outlet opening.

BACKGROUND OF THE INVENTION

By such a vacuum cleaner which is known from international patent publication WO 92/03210 A1, air polluted with airborne particles, like liquid, dust and dirt is being moved by means of vacuum towards the separator. When rotating the separator, centrifugal forces are exerted on the airborne particles due to which the airborne particles are being moved away from the separator, whilst the cleaned air flows through the separator towards the air outlet opening. Relatively heavy particles will be separated from the air at a relatively low rotational speed of the separator. However, to be able to remove relatively light particles as well, a relatively high rotational speed is needed. At such a relatively high rotational speed, the heavier particles might be moved towards the separator in axial direction and hit the separator with a relatively large force. The heavier particles might damage the separator due to which an unbalance of the rotating separator might occur, which will negatively influence the performance of the vacuum cleaner, especially at high rotational speeds.

SUMMARY OF THE INVENTION

It is an object of the invention to provide a vacuum cleaner with a rotatable separator, whereby damaging of the separator by relatively heavy particles is being prevented.

This object is achieved by the vacuum cleaner according to the invention in that the vacuum cleaner is provided with air-guide means for guiding at least part of the air towards the separator, wherein the separator is arranged between a wall of the chamber and the air-guide means, which air-guide means provides in use an at least partially closed boundary in axial direction for a column of rotating air around the separator, wherein a minimum distance $R_{ag}$ of an edge of the air-guide means to the rotating axis of the separator is larger than a distance $R_s$ of the air entrance opening of the separator to the rotating axis of the separator.

By rotating the separator a column of rotating air will be formed around the separator. Since the dimension of the air-guide means in radial direction is larger than the dimension of the separator, air with the airborne particles will be forced to be moved around the air-guide means towards the separator in a more or less radial direction. However, due to the centrifugal forces, the particles will then be moved away from the separator and fall downwards into a dust collecting container of the vacuum cleaner. The column of air will act as a pre-separator.

The air-guide means which also shields the separator prevents the particles from hitting the separator in axial direction, so damage to the separator is being avoided to a large extent.

Particles moving in axial direction towards the separator will hit the air-guide means. Thus the air-guide means also function as a shield. Larger particles may even damage the air-guide means.

In normal cases, a user is prevented from touching the separator, since the air-guide means and the separator will be mounted in a housing or a chamber. However, even under abnormal circumstances wherein the vacuum cleaner is not correctly used and wherein the separator may become located outside the housing, the air-guide means will prevent the user from touching the separator.

It has to be noticed that it is known to protect the separator from being hit by particles by means of a water bath filter, which catches away the particles before they impact upon the separator. The particles will remain in the filter, due to which the filter becomes clogged and the flow of air will be blocked. By the vacuum cleaner according to the invention, the flow of air can move around the air-guide means towards the separator.

An embodiment of the vacuum cleaner according to the invention is characterized in that the air-guide means is non-rotatable or is rotatable with respect to the separator at an angular velocity between null and a value lower than the angular velocity of the separator.

Since the air-guide means does not rotate or is being rotated at a much lower velocity than the separator, damage to the air-guide means will not influence the performance of the separator and will not or nearly not influence the performance and more particularly the dynamical performance of the vacuum cleaner.

Another embodiment of the vacuum cleaner according to the invention is characterized in that the column of rotating air around the separator has a maximum dimension H in axial direction, wherein the separator is rotatable during use at a maximum angular velocity · at which maximum angular velocity · air is flowing between the air inlet opening and the air outlet opening at a maximum flow rate Q in unloaded condition, wherein the minimum distance $R_{ag}$ of an edge of the air-guide means to the rotating axis of the separator satisfies the following relation:

$$R_{ag} \geq R_s * \left(1 + \left(\frac{Q}{2 * \pi * R_{ag}^2 * H * \omega}\right)\right)$$

An effect of this minimum distance is that particles that may possible damage the separator, are launched with such a velocity and such a direction into the column of rotating air, that these particles will miss the separator instead of bombarding it.

In this range there is an advantageous technical effect that airborne particles have enough time to gain velocity in a direction which is tangential to the separator on top of their radial velocity. Above a certain tangential velocity the particles will miss the separator and are accelerated away from the separator without impact and without causing damage to the separator.

The formula also reflects that there is a buffer zone around the separator. This buffer zone has the shape of a hollow cylinder. The inside diameter corresponds to the radial size of the separator while the outside diameter corresponds to the radial size of the air-guide means. The height H of this buffer corresponds to the dimension of the separator along the rotational axis. If the volume of this buffer zone exceeds the volume of air which is transported through the separator per radian of revolution of the separator, relatively heavy airborne particles remain for a sufficiently long period of time in the buffer zone to get thrown out of this zone without hitting the separator. Hence the air-guide means has, on top of its shielding function, a very specific aerodynamic effect which is among others determined by its size and position relative to the separator.

Yet another embodiment of the vacuum cleaner according to the invention is characterized in that a smallest distance $H_{s-ag}$ in axial direction of the axis between the separator and the air-guide means is such that in use less than 5%, more preferably 1% and even more preferably less than 0,1% of the particles picked up by the vacuum cleaner and having a size of at least 100 μm (micron) enter the separator.

With such an amount of particles reaching the separator, the damage to the separator will be minimal, wherein the lower percentages correspond to lee damage.

By such a distance most particles moving in axially direction towards the separator are being stopped by the air-guide means. Due to the column of rotating air around the rotating separator, all particles guided around the air-guide means will enter the column of rotating air. Due to the centrifugal forces, preferably all larger and heavier particles will then be moved away from the separator. Only relatively light particles will be moved through the column of rotating air and might enter the entrance openings of the separator. However, such particles will not or less severely damage the separator.

Yet another embodiment of the vacuum cleaner according to the invention is characterized in that the air-guide means is located at a fixed distance $H_{s-ag}$ from the separator.

Such an air-guide means can easily be mounted in a housing of the vacuum cleaner.

A further embodiment of the vacuum cleaner according to the invention is characterized in that the air-guide means is movable towards and away from the separator such that a smallest distance $H_{s-ag}$ in axial direction of the axis between the separator and the air-guide means is variable.

Such a movable air-guide means might be used to shut off the air entrance openings of the separator in case that the dust collecting container of the vacuum cleaner is full.

Yet another embodiment of the vacuum cleaner according to the invention is characterized in that the vacuum cleaner is provided with a chamber to be filled with liquid, whereby the air-guide means is floatable on the liquid.

When the chamber is being filled with liquid like water, the air-guide means will be moved towards the separator and might block off the air entrance openings of the separator or activate a switch to turn the vacuum cleaner off, when the level of liquid in the chamber is above a predetermined level. In this manner, liquid is being prevented from entering the separator.

Another embodiment of the vacuum cleaner according to the invention is characterized in that the air-guide means have a rounded shape, the axis of which coincides with the rotating axis of the separator.

With such a rounded shape, like conical or cylindrical, air can flow around the air-guide means at all locations directly into the column of rotating air.

Another embodiment of the vacuum cleaner according to the invention is characterized in that the separator comprises a centrifugal fan, whilst the vacuum cleaner further comprises a vacuum fan located between the separator and the air outlet opening, the centrifugal fan and vacuum fan are rotatable together about the rotating axis, whereby the vacuum fan has a larger diameter than the centrifugal fan.

By using two fans, the centrifugal fan will be used to separate the air from the airborne particles, whilst the vacuum fan is being used to move the air from the air inlet opening towards the air outlet opening. The centrifugal fan works counterproductive to the vacuum fan, but since the diameter of the vacuum fan is larger than the centrifugal fan, air will be still moved through both fans.

In yet another embodiment of the vacuum cleaner according to the invention the air-guide means defines a dust separation space for creating the column of rotating air around the separator and a particle collecting space of the chamber, for collecting particles separated from the air to prevent re-introduction of such particles into the column of rotating air.

The air-guide means define a boundary of a column of rotating air. Particles in the dust laden air around this column are separated if the energy of the column is confined to a restricted space around the separator. Once separated from the rotating column of air these particles are collected in another space of the chamber, viz. the particle collecting space. In the particle collecting space the particles are slowed down and immobilized to a large extent. The effect of such a slowdown and immobilization is that a majority of already separated particles is prevented from being reintroduced into the column of rotating air again. This contributes to the efficiency of the separation process. On the one hand the air-guide means confines the dust separation space for the rotating column, thereby keeping the energy density of the rotating air sufficiently high to perform the separation process in an efficient way. On the other hand the particle collecting, which is defined in the chamber by the air-guide means, prevents to a large extent that the energy of the rotating air is spent more on already separated particles. In this way the air-guide means prevents that the column of air stretches out too much through the chamber, thereby losing its separating intensity while at the same time sucking in already separated particles.

Canadian patent publication CA 978 485 A1 discloses an entrained material separator for use with a domestic vacuum cleaner and invluding a casing, inlet and outlet conduits which extend through the casing with their respective discharge and intake openings so disposed within the casing. The air flow inside the separator is drawn around the free edge of a baffle into inlet apertures of the outlet conduit. The change in direction of the air flow around the baffle causes a separation of any entrained liquid and a large portion of any entrained solid material. Any remaining entrained solids are separated from the air flow by a filter as the air passes through the outlet conduit. In a modification the baffle is secured coaxially to a rod and an axial flow propeller device is secured coaxially to an end of the rod, within the outlet conduit. Air flow through the outlet conduit will rotate the propeller and therefore the rod and the baffle about the axis of the separator. The rotation of the baffle reduces the possibility that wet entrained material will stick to the baffle when impinged thereon.

BRIEF DESCRIPTION OF THE DRAWINGS

The invention will be explained in more detail with reference to the drawings, in which.

Like parts are indicated by the same reference numbers in the figures.

DETAILED DESCRIPTION OF EMBODIMENTS

Figure 1:
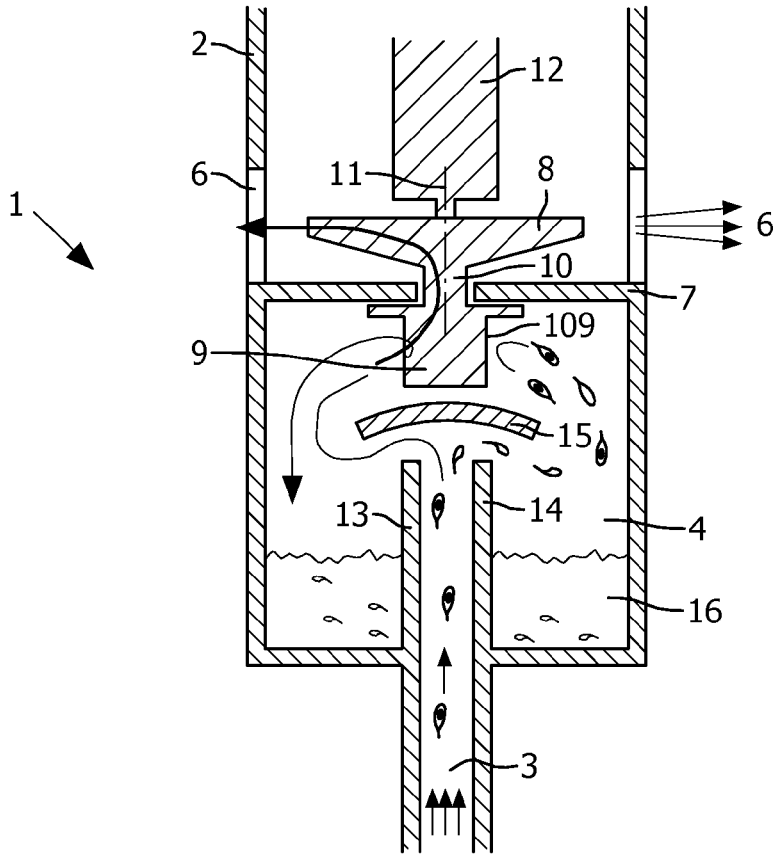
FIG. 1 is a schematic cross-section of a vacuum cleaner according to the invention.

FIGS. 1-6B show different views of an embodiment of a vacuum cleaner 1 according to the invention. The vacuum cleaner 1 comprises a housing 2 provided with an air inlet opening 3, a first chamber 4, a second chamber 5 and air outlet openings 6. The air inlet opening 3 is located at the bottom of the first chamber 4, whilst air outlet openings 6 are located in a wall of the second chamber 5. Between the first and second chambers 4, 5 a wall 7 is located. The vacuum cleaner 1 is also provided with a vacuum fan 8 located in the second chamber 5 and a centrifugal fan 9 located in the first chamber 4. The vacuum fan 8 and the centrifugal fan 9 are connected to each other by means of a hollow tube 10 extending through the wall 7. The vacuum fan 8 and the centrifugal fan 9 are rotatable together about the rotating axis 11 by means of a motor 12. Air will enter the centrifugal fan 9 through air entrance openings 109 and leave the vacuum fan 8 near the air outlet openings 6. The motor 12 is located in the second chamber 5. It is also possible to locate the motor 12 somewhere else in the vacuum cleaner outside the second chamber 5.

The air inlet opening 3 is formed by means of a tube 13 extending parallel to the rotating axis 11. Between an end 14 of the tube 13 and the centrifugal fan 9, an air-guide means 15 is located. The air-guide means 15 preferably has a round shape with an axis that coincides with the rotating axis of the centrifugal fan 9. In the embodiment as shown in FIG. 1 the air-guide means 15 is slightly curved away from the centrifugal fan 9, in the other figures the air-guide means 15 comprises a plate extending perpendicular to the rotating axis 11.

The diameter of the air-guide means 15 and the vacuum fan 8 are larger than the diameter of the centrifugal fan 9. The centrifugal fan 9 pumps air in a way that is counterproductive to the vacuum fan 8. This means that by the centrifugal fan 9 the air is directed in a direction opposite to a direction into which the air is being moved by the vacuum fan 8. Due to the difference in diameter of both fans 8, 9, air will still be moved towards the vacuum fan 8, whilst at least most airborne particles will be prevented by the centrifugal forces created by the centrifugal fan 9 from entering the centrifugal fan 9 and the vacuum fan 8.

The vacuum cleaner 1 is only schematically shown. It might also comprise means to move dust or dirt into the tube 13, means to apply a liquid like water on a surface to be cleaned etc.

The bottom of the first chamber 4 forms a dust collecting container for collecting the dust, dirt and liquid as picked up by the vacuum cleaner 1.

The vacuum cleaner 1 according to the invention works as follows.

By means of the motor 12 the vacuum fan 8 and the centrifugal fan 9 are being rotated about the rotating axis 11 in a direction as indicated by arrow P1, for example at a speed of more than 20000*2*π rad/min (20.000 rpm). Since the diameter of the vacuum fan 8 is larger than the diameter of the centrifugal fan 9, air which is polluted with airborne particles like dirt, dust and liquid droplets will be sucked through the tube 13 into the first chamber 4. The polluted air will hit the air-guide means 15 and part of the airborne particles will fall downwards to the bottom of the first chamber 4 into the liquid, like water that has already been collected. A particle collecting chamber 16 is thus formed.

Due to the rotating centrifugal fan 9 a column of rotating air 17 is being formed around the centrifugal fan 9. Polluted air will flow around the air-guide means 15 towards the centrifugal fan 9 and will enter the column of rotating air 17. Since the airborne particles are heavier than the air itself, the air will be moved through the centrifugal fan 9, the tube 10 and the vacuum fan 8 and will leave the vacuum cleaner 1 as cleaned air through the outlet opening 6. By means of the centrifugal fan 9 a centrifugal force will be exerted on the particles, due to which the particles will be moved away from the centrifugal fan 9. By means of the centrifugal fan 9 the particles are removed from the polluted air and mainly cleaned air will enter the centrifugal fan 9. The centrifugal fan 9 acts as a separator. The particles that are moved away far enough from the centrifugal fan 9, will fall into the water in the collecting space 16.

Figure 4:
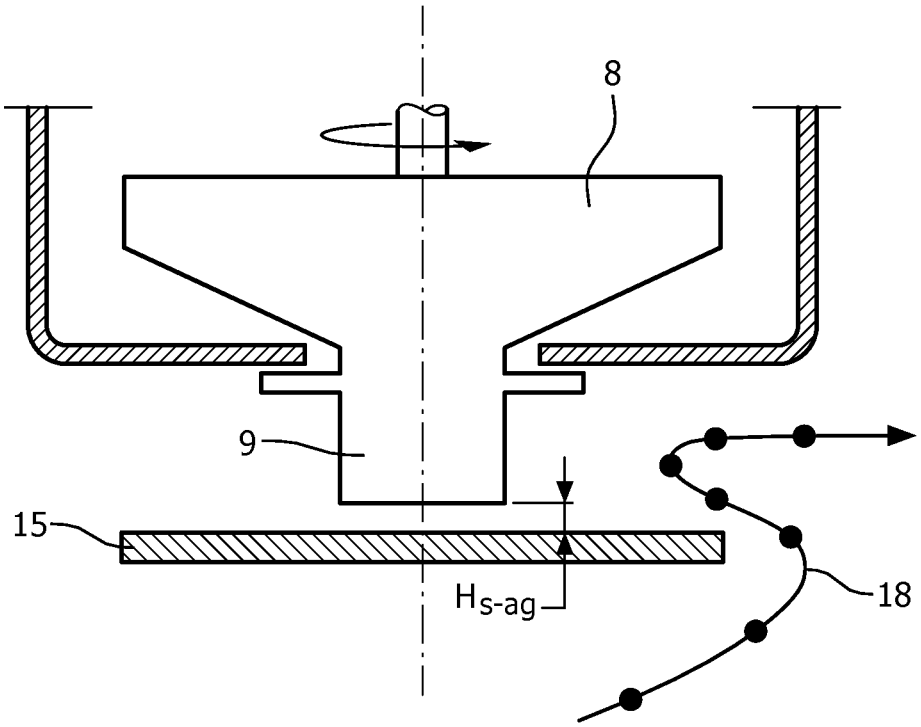
FIG. 4 is a cross section as shown in FIG. 2 indicating the movement of a relatively heavy particle.
Figure 5:
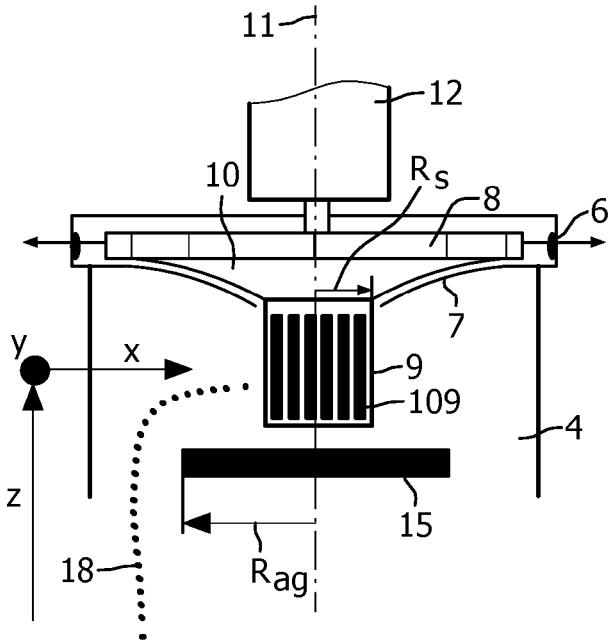
FIG. 5 is a side view of the a part of the vacuum cleaner similar to FIG. 2, FIGS. 6A and 6B are a schematic top view and enlarged part thereof of the air-guide means and the separator of a vacuum cleaner according to the invention.

FIG. 4 schematically shows a path 18 that such a particle might follow. Part of the trajectory or path 18 that the particle might follow is located in an imaginary space which is bounded by the centrifugal fan 9, the wall 7 and the air guide means 15 forming a bounding cylinder with radius $R_{ag}$ at the outside and a bounding cylinder with a radius $R_s$ at the inside with a maximum height H. These bounding cylinders thus capture the centrifugal fan 9 and the air-guide means 15. Said imaginary space has a volume which should be more than the volume of the air which is transported by the vacuum fan per radian of revolution of the centrifugal fan 9. In that way there is enough time to slow down the particles which approach the centrifugal fan 9 with a radial velocity component $V_x$. While slowing down these particles the tangential velocity component $V_y$ of these particles can than outweigh the radial velocity component $V_x$ such that an impact of the particles with the centrifugal fan 9 can be avoided. The size of the imaginary space determines the radial velocity $V_x$ at which the particles enter the space at a distance of $R_{ag}$ from the axis 11 of rotation. The flow of the air through the centrifugal fan 9 divided by the outside surface area determines the velocity at which the particles enter the imaginary space.

Figure 6A:
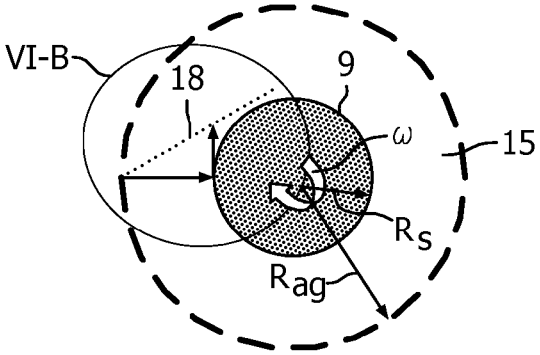
Figure 6B:
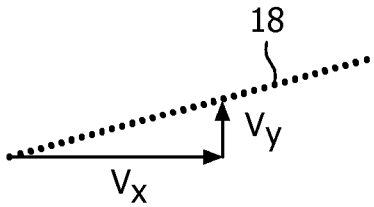

FIGS. 6A and 6B show schematically the velocity components $V_x$ and $V_y$ of a particle which initially determine the path 18 that it would like to follow when entering the column of rotating air 17 around the centrifugal fan 9. If the diameter of the air-guide means 15 is too small, heavier particles might hit the centrifugal fan 9 and damage it. The two velocity components $V_x$ and $V_y$ determine the angle at which particles are aimed when entering the column. If the angle is sufficiently large the particles will whizz beyond the centrifugal fan 9. Particles which are aimed at a too small angle may become a hit to the surface of the centrifugal fan 9 and cause considerable damage. By using a small $V_x$ the aiming angle can be kept sufficiently large. As explained above $V_x$ can be confined amongst others by enlarging the diameter of the air-guide means. However, if the diameter of the air-guide means 15 is too large, energy will be lost for moving the polluted air around the air-guide means 15 towards the centrifugal fan 9.

A desired radius $R_{ag}$ of the air-guide means, i.e. a radius which accounts for the above effects, can be calculated based on the following formula $$R_{ag} \cdot R_s + (V_x * R_s)/(\omega * R_{ag})$$

whereby:

$R_{ag}$ is the radius of the air-guide means 15, $R_s$ is the radius of the centrifugal fan 9, · is the rotational speed in rad/s of the centrifugal fan 9, $V_x$ is the inward flow velocity in radial direction towards the centrifugal fan 9.

Figure 2:
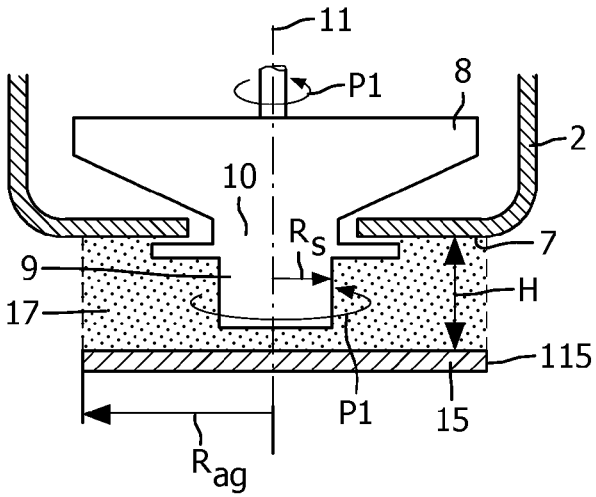
FIG. 2 is a cross section of a part of the vacuum cleaner as shown in FIG. 1.
Figure 3:
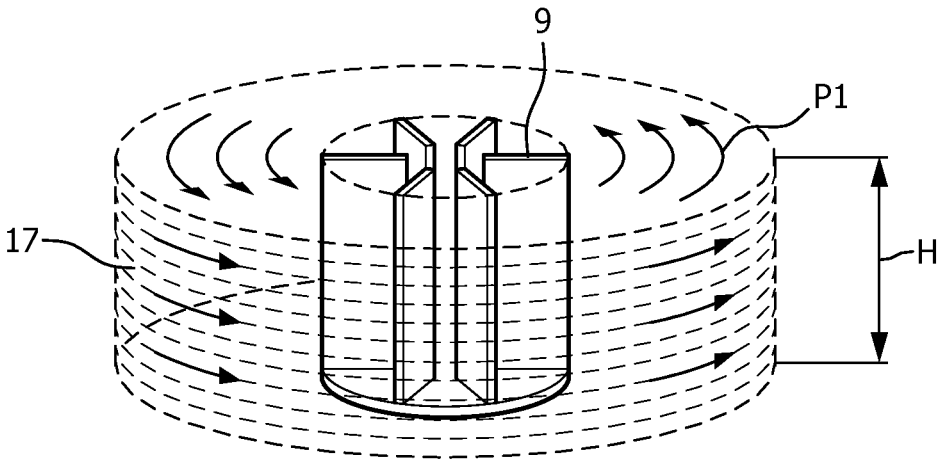
FIG. 3 is a perspective view of a column of rotating air around the separator as shown in FIG. 2.

As shown in FIGS. 2 and 3 the column of rotating air 17 has a height H between the air-guide means 15 and the wall 7. The surface S of the column of rotating air through which the air must flow to be able to move to the air outlet openings 6 is:

$$S = 2 \cdot R_{ag} * H$$

If the discharge Q at the air outlet openings 6 is known or measured, the maximum velocity $V_x$ can be calculated by:

$$V_x = Q/S$$

The discharge Q is the discharge running an emptied vacuum cleaner in an unloaded condition, with the tube 13 connected to free air. In such conditions the flowing resistance is minimal which results in a value of Q which can be considered as a maximum value for Q. The radius $R_{ag}$ can now be expressed as:

$$R_{ag} \geq R_s * \left(1 + \left(\frac{Q}{2 * \pi * R_{ag}^2 * H * \omega}\right)\right)$$

The maximum allowable height H of the column of rotating air and thereof the distance $H_{s\text{-}ag}$ of the air-guide means 15 to the centrifugal fan 9 can be experimentally determined by using a certain centrifugal fan 9 which is being rotated at a certain predetermined rotational speed · and a air-guide means 15 with a calculated radius $R_{ag}$. The air-guide means 15 are subsequently positioned at different positions with respective different heights H of the column of rotating air 17. For each height H, the amount A of particles with a size of more than 100 μm (micron) at the air entrance openings 109 is determined. The amount A should be preferably at least less than 5%, more preferably less than 1%, even more preferably less than 0,1% of the amount of particles bigger than 100 μm (micron) in the initial offered dust to keep the damage of the centrifugal fan 15 at an acceptable level and hence to provide a lifetime of the vacuum cleaner which is in the acceptable range.

Such particles can be collected in the air entrance openings 109 by using a kind of glue to which the particle will adhere or using a sample tube. It is also possible to use a device for measuring the amount and size of the particles by means of light. As such measurements form part of the state of the art they are not further discussed here.

Figure 7:
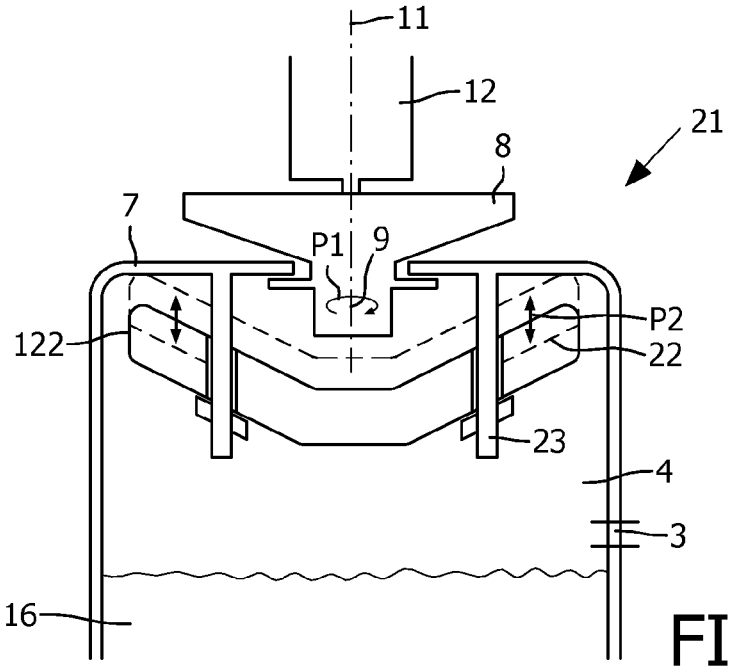
FIG. 7 is a side view of another vacuum cleaner according to the invention, FIGS. 8A en 8B are a cross section and a top view of another embodiment of a vacuum cleaner according to the invention.

FIG. 7 shows another embodiment of a vacuum cleaner 21 according to the invention, comprising a floatable air-guide means 22 which is movable in a direction as indicated by a double arrow P2 parallel to the rotating axis 11 of the centrifugal fan 9. the air-guide means 22 is guided along rods 23 extending from the wall 7. In the same manner as indicated above polluted air flows around the air-guide means 22 towards the centrifugal fan 9 in radial direction. In this manner, it is avoided that particles will hit the centrifugal fan 9 in axial direction. When using the vacuum cleaner 21, the level of water in a particle collecting space 16 in the first chamber 4 will raise. As soon as the water has reached the air-guide means 22, the air-guide means 22 will start floating and will be moved in upward direction to a position as indicated by the dotted lines. It will thereby close off the flow of air towards the centrifugal fan 9 and the vacuum cleaner 21 will stop working. After emptying the first chamber 4, the vacuum cleaner 21 can be used again.

Figure 8A:
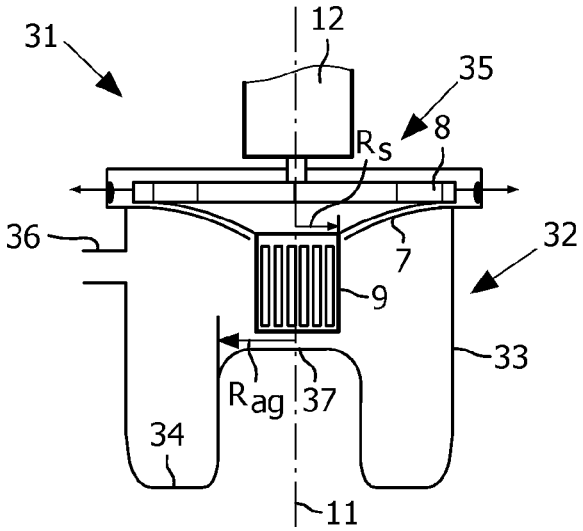
Figure 8B:
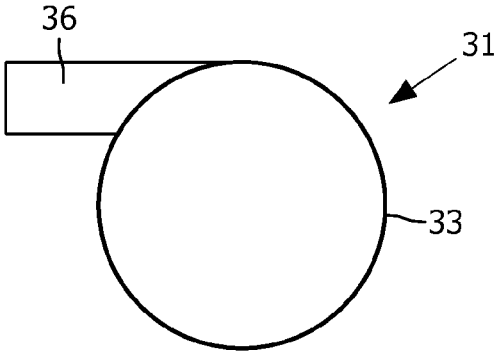

FIGS. 8A and 8B show another embodiment of a vacuum cleaner 31 according to the invention. The vacuum cleaner 31 comprises a housing 32 with cylindrical wall 33, a bottom part 34 and a top part 35. In the top part 35 a centrifugal fan 9, a wall 7 a vacuum fan 8 and a motor 12 are located.

A side of the cylindrical wall 33 comprises an air inlet opening 36 by means of which polluted air will enter the housing 33 in tangential direction at about the same level as the location of the centrifugal fan.

The bottom part 34 is provided with a centrally located raised portion 37 which is located relatively close to the centrifugal fan 9. The raised portion 37 acts as air-guide means in the same manner as the air guide means 15, 22. When using the vacuum cleaner 31, a column of rotating air will be formed between the wall 7 and the raised portion 37 and around the separator, preventing heavy dust particles from entering the centrifugal fan 9.

While the invention has been illustrated and described in detail in the drawings and foregoing description, such illustration and description are to be considered illustrative or exemplary and not restrictive; the invention is not limited to the disclosed embodiments.

For example, it is possible that the air-guide means has a square-shape, a shape of an octagon or any other kind of shape. The minimum distance of an edge of the air-guide means can be used as $R_{ag}$ in the above given formula. The air-guide means might be plate-shaped whereby the plate-shaped air-guide means extends perpendicular or at an angle of less than 90 degrees to the rotating axis of centrifugal fan.

The air-guide means may be made of material with a certain porosity which enables a part of the air and particles with a relatively small dimension to go through the air-guide means, whilst larger particles will be blocked by the air-guide means. Another part of the air will flow around the air-guide means.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. What in the figures is indicated as top and bottom may be upside down in a practical embodiment according to the invention or it may be even arranged at an angle with the vertical direction. The column of rotating air may be oriented in any direction and it is not necessary that the axis of said column coincides with the vertical direction. Any reference signs in the claims should not be construed as limiting the scope.

As the skilled person will appreciate, the concept of a vacuum cleaner has to be construed as a device which is suitable for cleaning the floor by causing a transport of particles by and in a flow of air. The flow of air does not necessarily have to be caused by vacuum as in regular vacuum cleaners; it can also be provoked by for example one or more rotating brushes which contact the floor and which pump up the air containing the particles by propelling mechanisms other than the creation of a vacuum as in most state of the art "vacuum" cleaners.

The invention claimed is:

1. A vacuum cleaner comprising:

an air inlet opening located in the bottom of a first chamber, an air outlet opening located in the wall of a second chamber, wherein a dividing wall separates the first and second chambers, a rotatable separator located at the top of the first chamber configured for separating air and airborne particles, which separator comprises at least one air entrance opening located between the air inlet opening and the air outlet opening, air-guide means located beneath the separator configured for guiding at least part of the air towards the separator, and further configured for shielding the rotatable separator from said airborne particles, a vacuum fan located in the second chamber arranged between the separator in the first chamber and the air outlet opening located in the wall of the second chamber, wherein the vacuum fan has a larger diameter than the separator, wherein the separator comprises a fan, wherein the rotatable separator is arranged in the second chamber between the dividing wall separating the first and second chambers and the air-guide means, wherein said air-guide means provides in use an at least partially closed boundary in axial direction for a column of rotating air around the separator, wherein a minimum distance ($R_{ag}$) of an edge of the air-guide means to the rotating axis of the separator is larger than a distance ($R_s$) of the air entrance opening of the separator to the rotating axis of the separator.

2. A vacuum cleaner according to claim 1, wherein the air-guide means is non-rotatable or is rotatable with respect to the separator at an angular velocity between null and a value lower than the angular velocity of the separator.

3. A vacuum cleaner according to claim 1, wherein the column of rotating air around the separator has a maximum dimension (H) in an axial direction, wherein the separator is rotatable during use at a maximum angular velocity (ω) at which a maximum angular velocity (ω) air is flowing between the air inlet opening and the air outlet opening at a maximum flow rate (Q) in an unloaded condition, wherein the minimum distance ($R_{ag}$) of an edge of the air-guide means to the rotating axis of the separator satisfies the following relation:

$$R_{ag} \geq R_s * \left(1 + \left(\frac{Q}{2 * \pi * R_{ag}^2 * H * \omega}\right)\right).$$

4. A vacuum cleaner according to claim 1, wherein a smallest distance ($H_{s\text{-}ag}$) in an axial direction of the axis between the separator and the air-guide means is such that in use less than 5%, more preferably 1% and even more preferably less than 0, 1% of the particles picked up by the vacuum cleaner and having a size of at least 100 μm (micron) enter the separator.

5. A vacuum cleaner according to claim 1, wherein the air-guide means is located at a fixed distance ($H_{s\text{-}ag}$) from the separator.

6. A vacuum cleaner according to claim 1, wherein the air-guide means is movable towards and away from the separator such that a smallest distance ($H_{s\text{-}ag}$) in an axial direction of the axis between the separator and the air-guide means is variable.

7. A vacuum cleaner according to claim 6, wherein the vacuum cleaner is provided with a chamber to be filled with liquid, whereby the air-guide means is floatable on the liquid.

8. A vacuum cleaner according to claim 1, wherein the air-guide means have a rounded shape, the axis of which coincides with a rotating axis of the separator.

9. A vacuum cleaner according to claim 1, wherein the fan and vacuum fan are rotatable together about a rotating axis.

10. A vacuum cleaner according to claim 1, wherein the air-guide means defines a dust separation space for creating the column of rotating air around the separator and a particle collecting space of the chamber, for collecting particles separated from the air to prevent re-introduction of such particles into the column of rotating air.

* * * * *